US007020301B2

(12) United States Patent
Koura et al.

(10) Patent No.: US 7,020,301 B2
(45) Date of Patent: Mar. 28, 2006

(54) LOUDSPEAKER

(75) Inventors: Satoshi Koura, Mie (JP); Takashi Suzuki, Mie (JP); Keiji Ishikawa, Mie (JP); Kazuro Okuzawa, Mie (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 134 days.

(21) Appl. No.: 10/450,775

(22) PCT Filed: Oct. 31, 2002

(86) PCT No.: PCT/JP02/11351

§ 371 (c)(1),
(2), (4) Date: Jun. 18, 2003

(87) PCT Pub. No.: WO03/041449

PCT Pub. Date: May 15, 2003

(65) Prior Publication Data

US 2004/0086147 A1 May 6, 2004

(30) Foreign Application Priority Data

Nov. 5, 2001 (JP) ..... 2001-339112
Nov. 30, 2001 (JP) ..... 2001-365851

(51) Int. Cl.
*H04R 25/00* (2006.01)

(52) U.S. Cl. ..... 381/421; 381/419; 381/420; 381/399

(58) Field of Classification Search ..... 381/396, 381/412, 426, 417–420, 190–191, 423, 431, 381/399, 424; 181/199
See application file for complete search history.

(56) References Cited

U.S. PATENT DOCUMENTS 4,273,968 A * 6/1981 Suyama ..... 381/421
4,276,452 A * 6/1981 Suyama et al. ..... 381/421
4,281,223 A * 7/1981 Ugaji et al. ..... 381/408
4,484,037 A * 11/1984 Nieuwendijk et al. ..... 381/408
4,612,420 A * 9/1986 Nieuwendijk et al. ..... 341/149
4,723,296 A * 2/1988 Nieuwendijk et al. ..... 381/399
5,214,710 A * 5/1993 Ziegenberg et al. ..... 381/412
5,604,815 A * 2/1997 Paddock ..... 381/396
6,671,383 B1 * 12/2003 Usuki et al. ..... 381/396

(Continued)

FOREIGN PATENT DOCUMENTS

EP 0999722 A2 * 5/2000

(Continued)

*Primary Examiner*—Sinh Tran
*Assistant Examiner*—Phylesha L Dabney
(74) *Attorney, Agent, or Firm*—Wenderoth, Lind & Ponack, L.L.P.

(57) ABSTRACT

A loudspeaker comprising at least one magnet 27, a yoke 24 fixed to a bottom surface of the magnet, a flat plate 26 fixed on an upper surface of the magnet, a magnetic circuit 29 having a magnetic gap 28 formed between the plate and the yoke, and a flat diaphragm 23 provided with a coil 21 disposed above the magnetic gap. The magnet has a width greater than that of the plate, and at least a part of the upper surface of the magnet is exposed so that it directly faces the diaphragm. According to the structure of the present invention, a larger volume magnet can be used without increasing the size of the magnetic circuit. Furthermore, as magnetic flux can be concentrated in an upper region of the magnetic gap, the magnetic circuit becomes efficient and compact. Thus a compact and high-efficiency loudspeaker for high frequency sound reproduction can be provided.

26 Claims, 8 Drawing Sheets

U.S. PATENT DOCUMENTS

2004/0091130 A1* 5/2004 Goller ..... 381/412

FOREIGN PATENT DOCUMENTS

| | | | |
|---|---|---|---|
| EP | 0999722 | A * | 10/2000 |
| JP | 48-24721 | | 3/1973 |
| JP | 51-117615 | | 10/1976 |
| JP | 54-163023 | | 12/1979 |
| JP | 57-46394 | | 3/1981 |
| JP | 57-30499 | | 2/1982 |
| JP | 57-48895 | | 3/1982 |
| JP | 59-134991 | | 9/1984 |
| JP | 62-115996 | | 5/1987 |
| JP | 62-216496 | | 9/1987 |
| JP | 8-140185 | | 5/1996 |
| JP | 9-130892 | | 5/1997 |
| JP | 10-276494 | | 10/1998 |
| JP | 11-215590 | | 8/1999 |
| JP | 2001-211497 | | 8/2001 |

* cited by examiner

LOUDSPEAKER

TECHNICAL FIELD

The present invention relates to a dynamic speaker used in various types of audio apparatus, more specifically, a loudspeaker suitable to reproduce high frequency range sounds.

BACKGROUND ART

Loudspeakers for reproducing high frequency range sounds are normally called tweeters. The DVD Audio, Super Audio, which are the audio equipment introduced recently to the market, reproduce the music sources whose frequency range has been extended to 20 kHz or even higher frequency. So, it is desired that the tweeters reproduce high frequency sounds higher than 20 kHz, preferably up to 100 kHz. At the same time, it is desired that loudspeakers be compact in size, in order to meet the generally prevailing trend in the field of audio equipment toward downsizing.

In the meantime, there has been a number of problems among the conventional tweeters with dome shaped diagrams in reproducing the sounds higher than 20 kHz.

To address a problem of decreasing driving force in the high frequency range, a modified structure in the tweeter, or a leaf tweeter, has been proposed.

A conventional leaf tweeter is described with reference to FIG. 9A–FIG. 9D, and FIG. 10. In FIG. 9A–FIG. 9D, and FIG. 10, diaphragm 23 is formed of film 20, coil 21 and frame 22, and magnetic circuit 29 comprises bottom yoke 24, outer yoke 25, plate 26, magnet 27 and two magnetic gaps 28 formed between outer surfaces of plate 26 and inner surfaces of outer yoke 25. Diaphragm 23 is disposed so that coil 21 is located on the upper level of magnetic gap 28, and frame 30 fixes diaphragm 23 and magnetic circuit 29. Conventionally, insulating cushion material 31 is provided between magnetic circuit 29 and diaphragm 23.

In the above-configured leaf tweeter, when electrical input is delivered to coil 21, a driving force is generated in coil 21 which has been integrated with film 20, and film 20 is driven by the driving force generated in coil 21 without loosing the driving force and film 20 radiates the sound waves. Thus the leaf tweeters are advantageous in reproducing sound waves higher than 20 kHz.

However, the above-described leaf tweeters have the following drawbacks:

(1) The width of magnetic gap 28 in leaf tweeters is several times as large as that of generally-used dome-diaphragm tweeters. This results in a decreased magnetic flux density. Furthermore, since the most concentrated magnetic flux in the magnetic gap 28 is not used, an efficiency of magnetic circuit 29 is low due to its structure.

Namely, in order to make the magnetic flux concentrated to magnetic gap 28, the conventional leaf tweeters are provided with plate 26 having a width at least the same as that of magnet 27, and outer yoke 25 equipped with a protrusion protruding towards magnetic gap 28, as shown in FIG. 9A–FIG. 9D. Furthermore, a magnetically saturated condition is created within outer yoke 25 for diffusing as much magnetic flux upward. The magnetic flux, however, diffuses also downward; therefore, it is difficult to collect the magnetic flux from magnet 27 efficiently upward to the upper level of magnetic gap 28, where coil 21 is disposed.

(2) As reproduction sound pressure of a loudspeaker increases in proportion to a magnetic flux density of magnetic gap 28, a size of magnet 27 has to be increased to make the sound pressure high. Larger magnet 27 naturally necessitates larger plate 26 fixed on the upper surface of magnet 27. Bottom yoke 24 and outer yoke 25 are also required to be larger. These lead to a larger size magnetic circuit 29, which does not meet with the recent requirement for compact loudspeakers.

(3) In the conventional loudspeakers, directions of magnetic flux at two magnetic gaps 28A and 28B shown in FIG. 10 are opposite to each other. Therefore, a direction of electric current is reversed between coils 21A and 21B. Although one portion provided for reversing the direction of electric current is utilized as a connection member for connecting with a lead wire, the opposite portion is not exposed to the magnetic flux. Therefore, this portion has remained as one of the elements that deteriorate efficiency of the coil. Thus, if a larger driving force is required in a loudspeaker of a conventional structure, it has been difficult to make the loudspeaker small and light in weight, as it inevitably necessitated an enlarged magnetic circuit.

The present invention addresses the above-described problems, and aims to provide an excellent loudspeaker that has a compact magnetic circuit yet can generate a sufficiently high sound pressure.

DISCLOSURE OF THE INVENTION

A speaker in accordance with the present invention comprises at least one magnet, a yoke fixed to a bottom surface of the magnet, a flat plate fixed on an upper surface of the magnet, a magnetic circuit having a magnetic gaps formed between the plate and the yoke, and a flat diaphragm having coil disposed above the magnetic gap. The magnet has a width greater than that of the plate, and at least a part of the upper surface of the magnet is exposed and faces directly to the diaphragm. According to a structure in accordance with the present invention, a volume of the magnet can be increased without increasing a size of the magnetic circuit. Furthermore, the magnetic flux can be concentrated to a portion above the magnetic gap, allows the magnetic circuit to be made efficient and compact. Thus a compact and high-efficiency speaker suitable for the reproduction of high frequency range sounds can be provided.

DESCRIPTION OF THE PREFERRED EMBODIMENTS

Figure 1A:
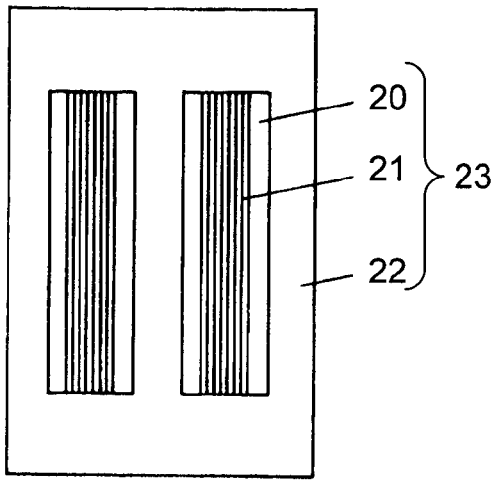
FIG. 1A is a plan view of diaphragm of a loudspeaker in accordance with a first exemplary embodiment of the present invention.
Figure 1C:
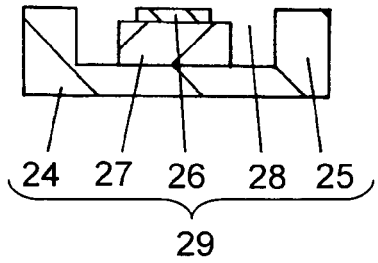
FIG. 1C is a cross sectional view of FIG. 1B, sectioned along line A-B.
Figure 1B:
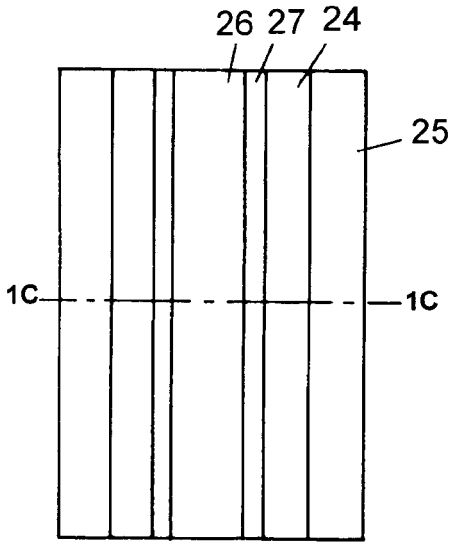
FIG. 1B is a plan view of a magnetic circuit of a loudspeaker in accordance with the first exemplary embodiment of the present invention.

Loudspeakers in accordance with exemplary embodiments of the present invention are described in the following referring to the drawings. Those portions identical to those of conventional technology are represented by the same numerals, and descriptions of such portions are omitted.

Embodiment 1

A loudspeaker in accordance with a first exemplary embodiment of the present invention is described with reference to a leaf tweeter as shown in FIG. 1A–FIG. 1D.

Referring to FIG. 1A–FIG. 1D, diaphragm 23 is formed of film 20, coil 21 and frame 22. A leaf tweeter in the present embodiment has magnetic circuit 29 comprising bottom yoke 24 provided with outer yoke 25, magnet 27 fixed on bottom yoke 24 and magnetized vertically, plate 26 attached on magnet 27, and two magnetic gaps 28 formed between an outer surface of plate 26 and inner surfaces of outer yoke 25.

Diaphragm 23 is disposed so that coil 21 is located above magnetic gap 28, and frame 30 fixes diaphragm 23 and magnetic circuit 29. Insulating cushion material 31 is provided between magnetic circuit 29 and diaphragm 23.

A difference of the leaf tweeter in the present embodiment with respect to the conventional leaf tweeter is that a width of magnet 27 is greater than that of plate 26. The structure according to the present embodiment provides the following advantages:

(1) On the upper surface of magnet 27, the magnetic flux generated by magnet 27 flows along two paths. Namely, in the region where plate 26 is disposed, the magnetic flux generated from magnet 27 flows through an inside of plate 26 and reaches to the inner surface and an upper surface of outer yoke 25. A magnetic flux generated from the exposed region, or a region not provided with plate 26, flows upward, because of the direction of magnetization, and reaches to the inner surface and the upper surface of outer yoke 25. Thus in the magnetic circuit of the present embodiment, the magnetic flux is concentrated to a location above magnetic gap 28 more than that in a conventional magnetic circuit. As a result, a magnetic flux density to affect coil 21 disposed above magnetic gap 28 increases and an efficiency of the leaf tweeter is increased.

(2) Plate 26 can be made thinner. By taking advantage of the magnetic saturation with thinned plate 26, the magnetic flux can be directed upward. Namely, being different from the conventional structure, magnetic flux is not directed downward. As a result, the magnetic flux density that works on coil 21 disposed above gap 28 increases to increase the efficiency of the leaf tweeter.

(3) The entire size of magnetic circuit 29 does not need to be increased even when the width of magnet 27 is increased. Thereby, a magnetic circuit that is compact yet provides a strong magnetic flux can be obtained.

(4) By the same principle as described above, magnetic circuit 28 having magnet 27 of the same size provides stronger magnetic flux by reducing the width of plate 26 to be smaller than that of magnet 27.

(5) It becomes unnecessary to machine the surface of outer yoke 25 facing magnetic gap 28 to have a protrusion or the like shape. Thus, machining costs for bottom yoke 24 and outer yoke 25, as well as relevant parts costs, can be reduced. Furthermore, overall height of magnetic circuit 29 can be reduced.

Figure 1D:
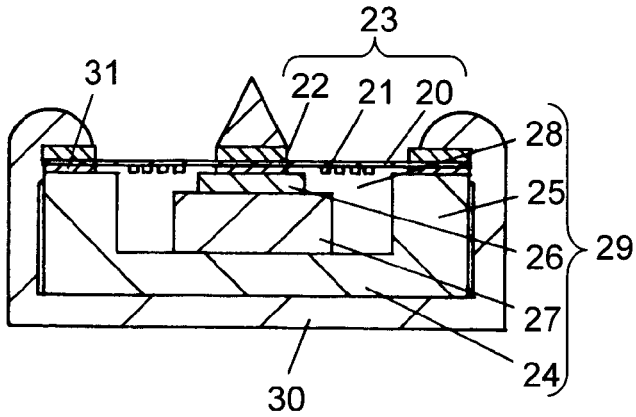
FIG. 1D is a cross sectional view of the loudspeaker in accordance with the first exemplary embodiment of the present invention.

As an amplitude is small with the leaf tweeters, diaphragm 23 does not hit the upper surface of magnet 27 even if thin plate 26 is used. So, a distance between innermost windings of right and left coils 21 can be made shorter than a width of magnet 27, as shown in FIG. 1D. Consequently, a number of windings of coil 21 within a limited space of magnetic gap 28 can be increased in the structure of the present embodiment. As a result, the driving force, which is determined by a product of length of coil 21 and magnetic flux density to affect coil 21, can be made greater. Depending on conditions, the width of respective coils can be made greater than a space between magnet 27 and outer yoke 25. Thus, the loudspeaker efficiency can be increased to a sufficiently high level.

Embodiment 2

Figure 2A:
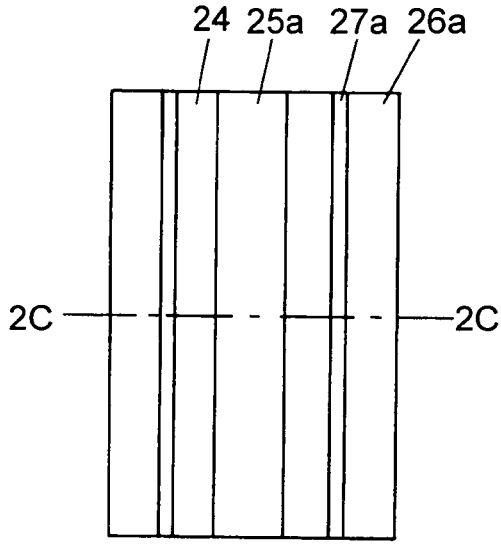
FIG. 2A is a plan view of a magnetic circuit in accordance with a second exemplary embodiment of the present invention.
Figure 2B:
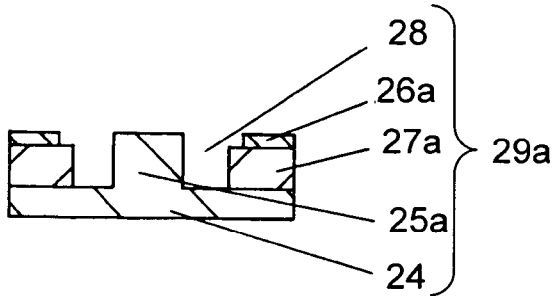
FIG. 2B is a cross sectional view of FIG. 2A, sectioned along line A-B.
Figure 2C:
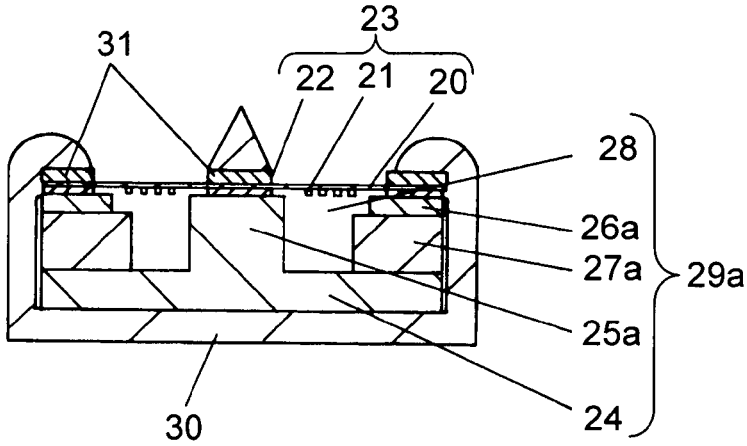
FIG. 2C is a cross sectional view of a loudspeaker in accordance with the second exemplary embodiment of the present invention.

A loudspeaker in accordance with a second exemplary embodiment of the present invention is described with reference to a leaf tweeter as shown in FIG. 2A–FIG. 2C. Those portions identical to those of the first embodiment are represented by the same numerals, and the description of such portions are omitted. The diaphragm in the present embodiment remains the same as that in the first embodiment.

A difference from the first embodiment is the shape of magnetic circuit 29*a*. In the present embodiment, two magnets 27*a* magnetized both in the same vertical direction are used and plates 26*a* and bottom yoke 24 are fixed on an upper surface and a bottom surface of magnets 27*a*, respectively. Namely, magnetic gap 28 in the present embodiment is formed between an outer surface of protruding yoke 25*a* protruded at a middle of bottom plate 24 and an inner surface of plate 26*a*.

In the above-described configuration, the magnetic flux generated by magnet 27*a* at the upper surface flows along two paths. Namely, at a region where plate 26*a* is disposed, the magnetic flux generated from magnet 27*a* flows through the inside of plate 26*a*, and flows towards the inner surface and an upper surface of protruding yoke 25*a*. Magnetic flux generated from the exposed region, or a region where no plate 26*a* is provided, flows upward because of the direction of magnetization, and flows towards the inner surface and the upper surface of protruding yoke 25*a*. Thus the magnetic flux is concentrated more at a region above magnetic gap 28, and a magnetic flux density to affect coil 21 disposed above magnetic gap 28 increases and an efficiency of a loudspeaker increases.

The use of two magnets 27*a* allows for a stronger magnetic circuit 29*a* for a leaf tweeter. Thus, a compact yet highly efficient magnetic circuit is obtained, like in the first embodiment.

Furthermore, when diaphragm 23 is provided so that a distance between outermost windings of two coils 21 is greater than a distance between the inner surfaces of two magnets 27*a*, as shown in FIG. 2C, a number of windings of coils 21 available within a limited space of magnetic gap 28 can be effectively increased. Thus a higher loudspeaker efficiency can be obtained, like in the first embodiment.

Embodiment 3

A loudspeaker in accordance with a third exemplary embodiment of the present invention is described with reference to FIG. 3A–FIG. 3D. A loudspeaker in the present embodiment 3 is a round leaf tweeter. Although the round leaf tweeter appears to be different from the speakers in the earlier embodiments 1 and 2, those portions having identical functions are described by using the same numerals.

Points of difference from the first and the second embodiments are that the plan views of a shape of diaphragm 23 and a magnetic circuit 29 are round, and that diaphragm 23 includes two vibrating portions.

The present embodiment is described in the following, focusing on the above-described points of difference.

As an efficiency of a loudspeaker improves in proportion to an area of diaphragm 23, a vibrating area should be as large as possible. However, expansion in the area of diaphragm 23 in the conventionally configured leaf tweeters, or in leaf tweeters having structures as described in the earlier embodiments, naturally results in an increased magnetic gap 28. Expanded magnetic gap 28 leads to an increased magnetic resistance in a magnetic flux path, and, as a result, deteriorates magnetic flux density and lowers the loudspeaker efficiency.

In the present embodiment, in order to increase the area of diaphragm 23 without increasing the width of magnetic gap 28, the plan view of magnetic circuit 29 is made to have a round shape, and a width of magnet 27 is made to be larger than that of plate 26, as shown in FIGS. 3A–3D. Thus, a further improvement in the efficiency is aimed for.

In the above-described configuration in accordance with the present invention, magnetic flux generated from the upper surface of magnet 27 shows four paths, each of an inner magnetic gap 28 and an outer magnetic gap 28 having two paths, respectively.

With respect to the inner magnetic gap 28, the magnetic flux generated from magnet 27 in the region of plate 26 flows through the inside of plate 26, and flows towards a peripheral surface and the upper surface of central protruding yoke 25*a*. The magnetic flux generated from the exposed region, or the region where there is no plate 26, flows upward because of the direction of magnetization, and flows towards the peripheral surface and the upper surface of central protruding yoke 25*a*.

With respect to the outer magnetic gap 28, a magnetic flux generated from magnet 27 in the region of plate 26 flows through the inside of plate 26, and flows towards the inner surface and the upper surface of outer yoke 25. A magnetic flux generated from exposed region, or the region where there is no plate 26, flows upward because of the direction of magnetization, and flows towards the inner surface and the upper surface of outer yoke 25.

Thus the magnetic flux is concentrated to the area above magnetic gaps 28, and the density of magnetic flux to affect coil 21 can be efficiently increased, wherein coil 21 is divided into two portions and disposed on diaphragm 23, and the divided portions are respectively disposed on two magnetic gaps 28. Consequently, the loudspeaker speaker efficiency is increased.

Figure 3A:
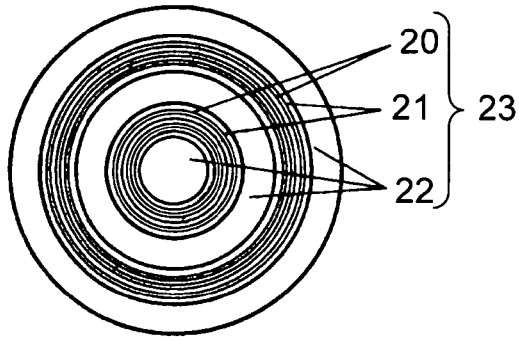
FIG. 3A is a plan view of a diaphragm of a loudspeaker in accordance with a third exemplary embodiment of the present invention.
Figure 3B:
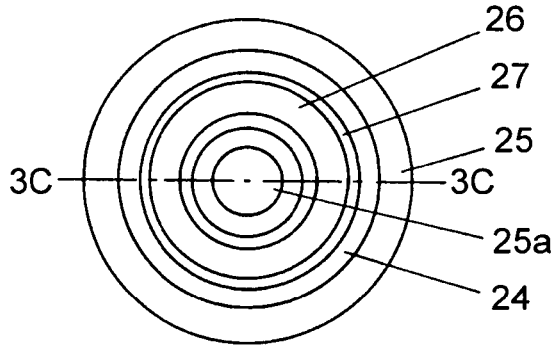
FIG. 3B is a plan view of a magnetic circuit of a speaker in accordance with the third exemplary embodiment of the present invention.
Figure 3C:
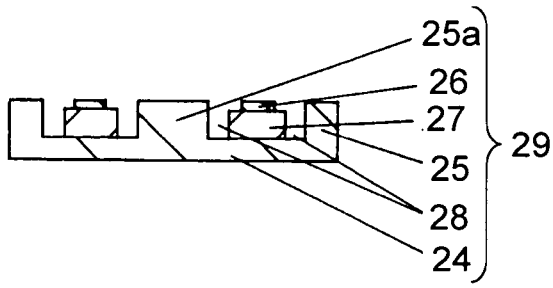
FIG. 3C is a cross sectional view of FIG. 3B, sectioned along line A-B.
Figure 3D:
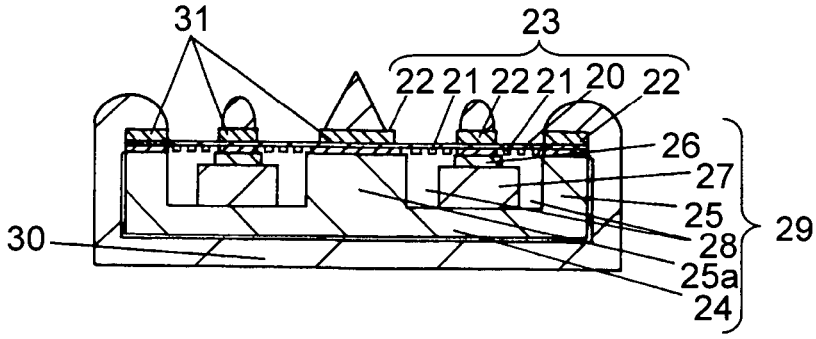
FIG. 3D is a cross sectional view of a speaker in accordance with the third exemplary embodiment of the present invention.

Furthermore, as shown in FIG. 3D, by making an outermost diameter of coil 21 disposed on the inner magnetic gap 28 to be greater than an inner diameter of magnet 27, and an innermost diameter of coil 21 disposed above the outer magnetic gap 28 to be smaller than an outer diameter of magnet 27, turns of coils 21 available within a limited space of magnetic gap 28 can be increased effectively. Thus the efficiency of a loudspeaker can be increased to a satisfactory level, in the same manner as in the first and the second embodiments.

Embodiment 4

Figure 4A:
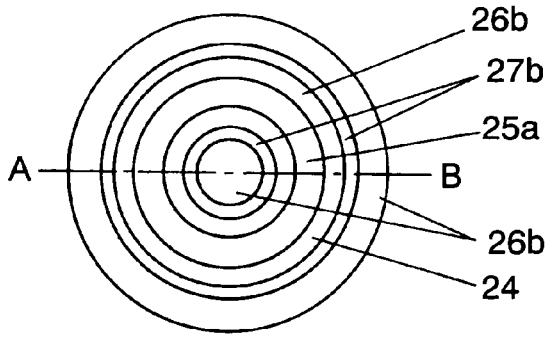
FIG. 4A is a plan view of a magnetic circuit of a speaker in accordance with a fourth exemplary embodiment of the present invention.
Figure 4B:
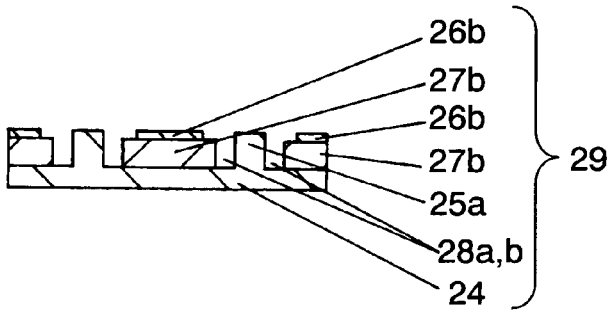
FIG. 4B is a cross sectional view of FIG. 4A, sectioned along line A-B.
Figure 4C:
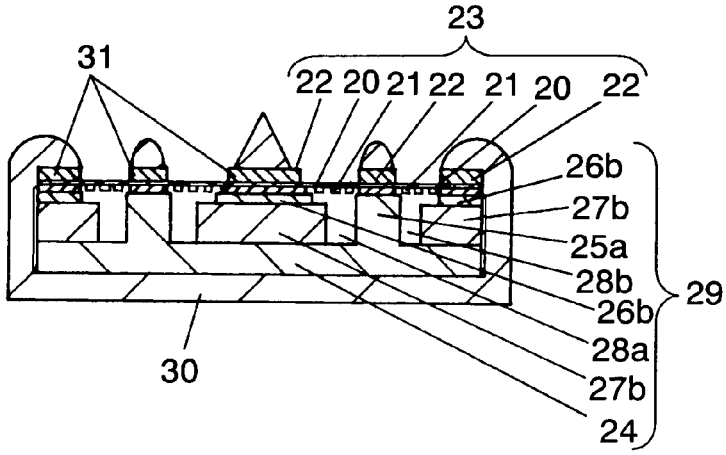
FIG. 4C is a cross sectional view of a speaker in accordance with the fourth exemplary embodiment of the present invention.
Figure 5:
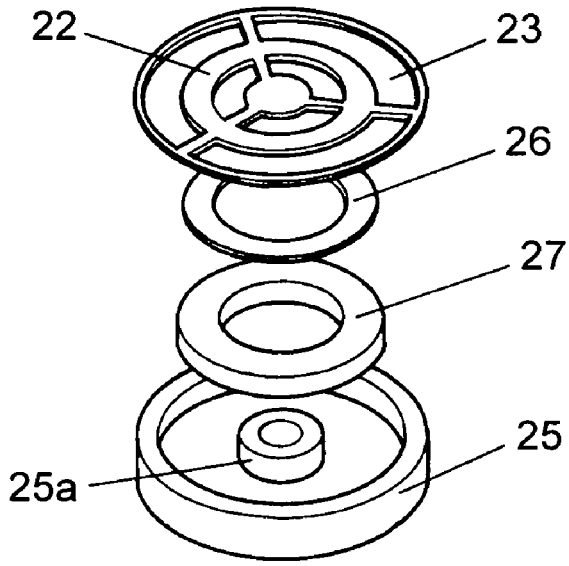
FIG. 5 is an exploded perspective view of a speaker in accordance with a fifth exemplary embodiment of the present invention.
Figure 6:
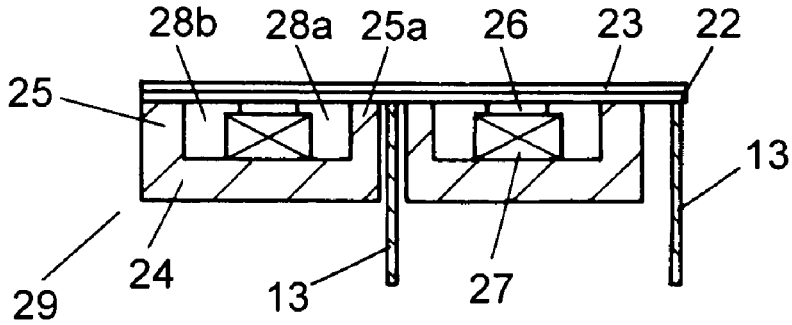
FIG. 6 is a cross sectional side view, used to describe a relationship between a diaphragm and a magnetic circuit.
Figure 7:
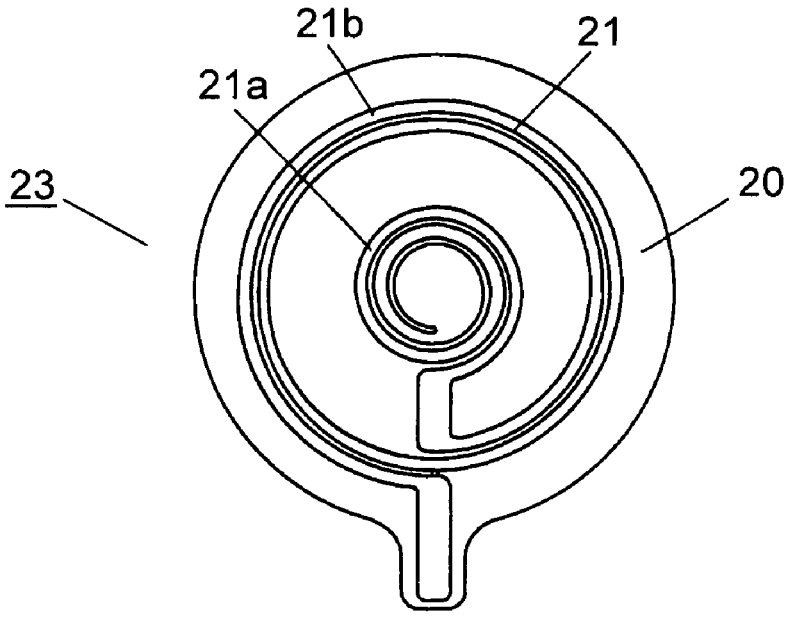
FIG. 7 is a plan view of a diaphragm according to the fifth exemplary embodiment.

A loudspeaker in accordance with a fourth exemplary embodiment of the present invention is described with reference to a leaf tweeter as shown in FIG. 4A– FIG. 4C. Those portions identical to those in the first embodiment are represented by the same numerals. A diaphragm in the present embodiment has the same shape as in the third embodiment.

A point of difference from the third embodiment is in a structure of magnetic circuit 29. In the present embodiment, two magnets 27*b* are used to increase the magnetic flux density at two magnetic gaps 28*a* and 28*b*.

Namely, in the structure in accordance with the present embodiment, two magnets 27*b*, a disc-shaped magnet and a ring-shaped magnet, are used, and both of two magnets are magnetized in the same vertical direction. The bottom surfaces of respective magnets 27*b* are fixed on bottom yoke 24, while on the upper surfaces of magnets 27*b*, plates 26*b*, a disc-shaped plate and a ring-shaped plate, are fixed, respectively. A diameter of the disc-shaped magnet 27*b* is greater than that of the disc-shaped plate 26*b*, while an inner diameter of the ring-shaped magnet 27*b* is smaller than an inner diameter of the ring-shaped plate 26*b*. Thus, portions of upper surfaces of two magnets 27*b* are exposed upwards. Magnetic gap 28*a* is formed between an inner surface of ring-shaped protruding yoke 25*a*, which is provided on bottom yoke 24, and an outer surface of disc-shaped plate 26*b*. Also, another magnetic gap 28*b* is formed between an outer surface of protruding yoke 25*a* and an inner surface of ring-shaped plate 26*b*.

In the above-described configuration, the magnetic flux supplied from central disc-shaped magnet 27*b* towards inner magnetic gap 28*a*, and the magnetic flux supplied from outer ring-shaped magnet 27*b* towards outer magnetic gap 28*b* exhibit two paths respectively, resulting in four magnetic flux paths in all.

With respect to inner magnetic gap 28*a*, the magnetic flux supplied from the disc-shaped magnet 27*b* at the region of plate 26*b* flows through the inside of plate 26*b*, and flows towards the inner surface and the upper surface of protruding yoke 25*a*. The magnetic flux supplied from the exposed region, or the region where there is no plate 26*b*, flows upward because of the direction of magnetization, and flows towards the inner surface and the upper surface of protruding yoke 25*a*.

With respect to outer magnetic gap 28*b*, the magnetic flux supplied from magnet 27*b* at the region of ring-shaped plate 26*b* flows through the inside of plate 26*b*, and flows towards the outer circumference surface and upper surface of protruding yoke 25*a*. The magnetic flux supplied from the exposed region, or the region where there is no ring-shaped plate 26, flows upward because of the direction of magnetization, and flows towards the outer surface and the upper surface of protruding yoke 25*a*.

Thus the magnetic flux is concentrated to the regions above magnetic gaps 28, and the magnetic flux density to affect coil 21, which is divided into two portions and disposed above magnetic gaps 28*a*, 28*b*, respectively, can be efficiently increased. Consequently, the loudspeaker efficiency is increased. Coil 21 in the present embodiment is formed on diaphragm 23 by a printing process.

Furthermore, as described in the third embodiment, since many turns of coils 21 can be formed effectively within a limited space of magnetic gaps 28*a*, 28*b*, the efficiency of the loudspeaker can be increased to a sufficiently high level.

Other components other than magnetic circuit 29 shown in the above drawings, such as frame 31, are irrelevant to the downsizing and efficiency improvement of magnetic circuit 29. Therefore, shapes of such components illustrated in the drawing are only the examples and these components may of course take other different shapes.

Although magnetic circuit 29 and diaphragm 23 in the third and the fourth embodiments are described based on a round shape, they may have an oblong circle or a rectangular shape, instead, for example, to yield the same advantages.

Embodiment 5

A loudspeaker in accordance with a fifth exemplary embodiment of the present invention is described with reference to a leaf tweeter as shown in FIG. 5–FIG. 8. Those portions having identical functions as those in the first and the third embodiments are described by the same numerals.

Referring to FIG. 5 through FIG. 8, diaphragm 23 is attached to frame 22. Plate 26, magnet 27, outer yoke 25 remain the same as those in the third embodiment. Protruding yoke 25*a* in the present embodiment is protruding on the inner bottom surface and is provided at a center with a hole through which lead 13 extends out.

In the same manner as in the third embodiment, inner magnetic gap 28*a* is formed between magnet 27 fixed on the inner bottom surface of bottom yoke 24, plate 26 and protruding yoke 25*a*, while outer magnetic gap 28*b* is formed between magnet 27, plate 26 and outer yoke 25.

Diaphragm 23 in the present embodiment is made of insulating film 20 and coil 21 formed thereon. Coil 21 consists of inner coil 21 corresponding to inner magnetic gap 28*a* and outer coil 21 corresponding to outer magnetic gap 28*b*. Inner coil 21 and outer coil 21 are continued, while winding directions of the respective coils are reversed to each other. The two coils 21 are disposed so that each of the respective coils is above outer magnetic gap 28*b* and inner magnetic gap 28*a* formed between yoke 25, magnet 27 and plate 26. When an electric signal is delivered to both ends of coil 21, insulating film 20 vibrates to generate sounds.

Since both magnetic gaps 28*a* and 28*b* are formed with a single magnet 27, the directions of magnetic fields in inner magnetic gap 28*a* and outer magnetic gap 28*b* are opposite to each other. So, if inner coil 21 and outer coil 21 were wound in the same direction, the sounds cancel each other, rendering it impossible to secure a sound pressure. This is the reason why coil 21 on magnetic gap 28*a* and coil 21 on magnetic gap 28*b* are wound in reverse directions.

Since inner coil 21 and outer coil 21 have been formed as a single integrated coil 21, the coil can be connected with leads 13 only at one inner point and at one outer point to the save spaces for connections, and to simplify connecting operations. Coil 21 may be formed through any one of the known technologies such as printing of conductive paint, etching of metal foil, vacuum deposition, sputtering, adhesion of coil-shaped metal foil, etc.

Since protruding yoke 25*a* in the present embodiment is provided with a through hole, connection of end of coil 21 and lead 13 can be made using the through hole. As a result, there is no need to form lead 13 on diaphragm 1, which contributes to an efficient utilization of space on diaphragm 1 and a reduction of weight of diaphragm 1. Depending on designing needs, another through hole may be provided in magnet 27 and plate 26, or in outer yoke 25, through which lead 13 can be extended out.

Figure 8:
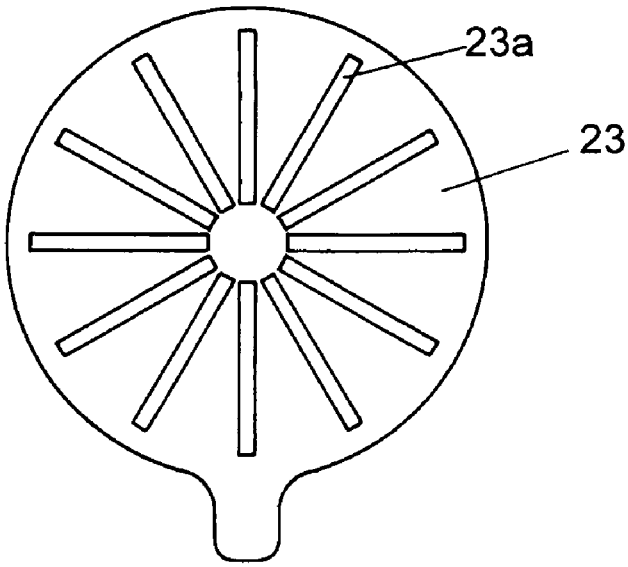
FIG. 8 is a plan view of diaphragm of a speaker in accordance with the fifth exemplary embodiment of the present invention.
Figure 9A:
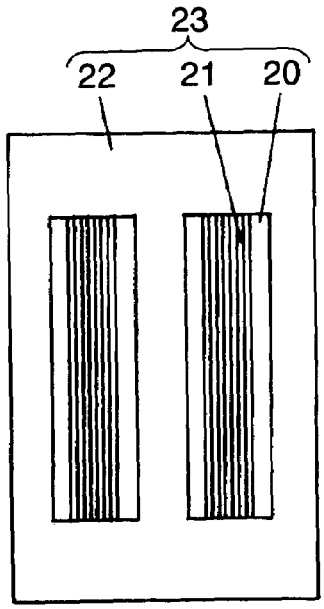
FIG. 9A is a plan view of a diaphragm of a conventional leaf tweeter.
Figure 9C:
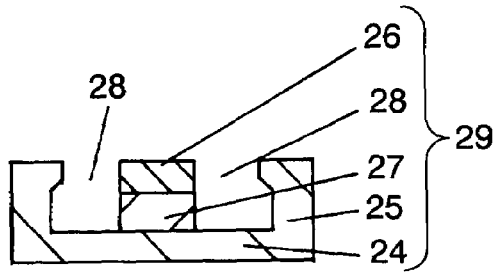
FIG. 9C is a cross sectional view of FIG. 9B, sectioned along line A-B.
Figure 9B:
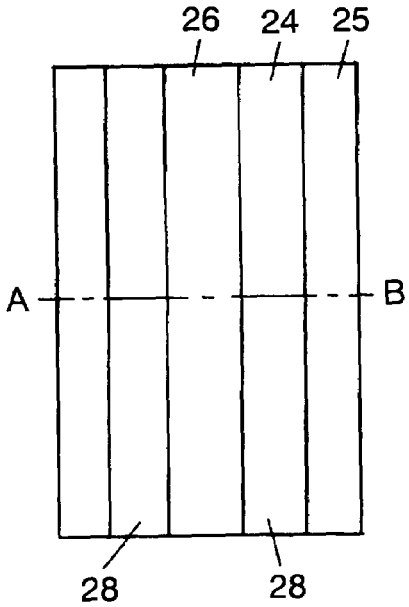
FIG. 9B is a plan view of a magnetic circuit of a conventional leaf tweeter.
Figure 9D:
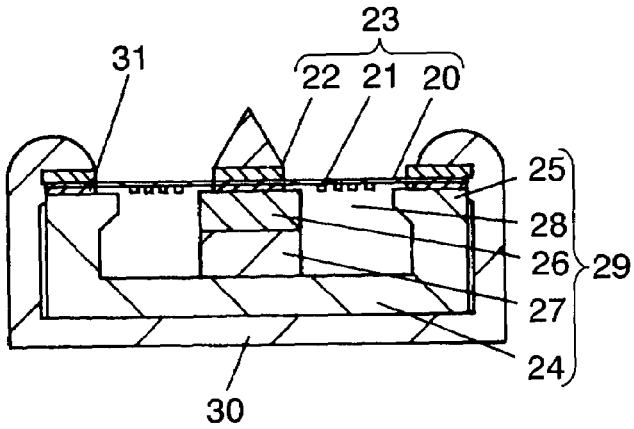
FIG. 9D is a cross sectional view of a conventional leaf tweeter.
Figure 10:
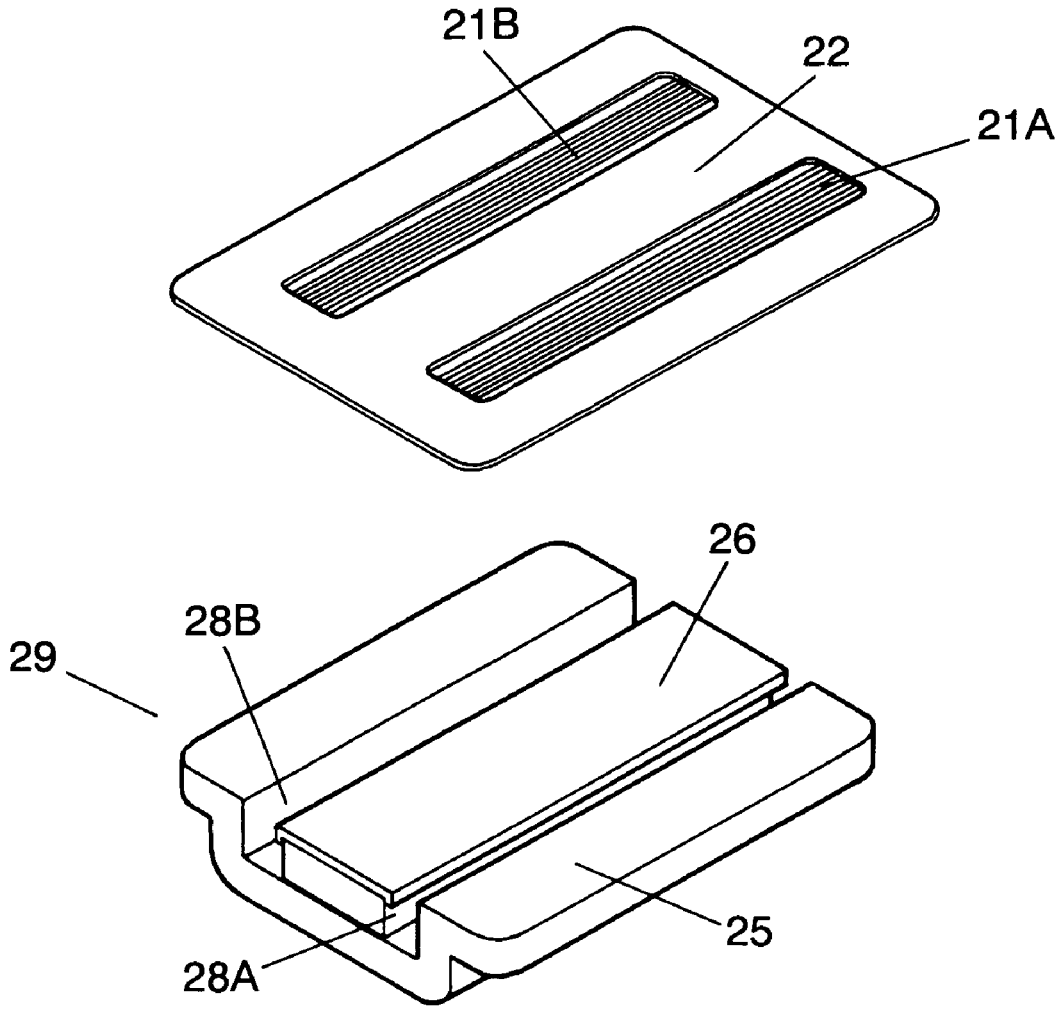
FIG. 10 is an exploded perspective view of a conventional leaf tweeter.

Diaphragm 23 in the present embodiment may be provided with wrinkles 23*a* for reinforcement, as illustrated in FIG. 8. Wrinkles 23*a* may be provided in radial directions with approximately equal angular intervals. Wrinkles 23*a* improve the rigidity and suppresses a distortion in diaphragm 23, and also make the rigidity of diaphragm even over the whole area. By taking advantage of these effects, diaphragm 23 vibrates in a stable manner, and the characteristics of the loudspeaker are improved.

INDUSTRIAL APPLICABILITY

The above-described configuration of the magnetic circuit in the leaf tweeters, where the width of the magnet is made to be greater than that of the plate so that part of upper surface of the magnet is exposed at least to the magnetic gap side, enables the provision of a magnetic circuit that is small in size yet yields high efficiency. This helps to improve the efficiency of small leaf tweeters.

The invention claimed is:

1. A loudspeaker comprising:

a magnetic circuit comprising a magnet, a yoke fixed to a bottom surface of said magnet, and a flat plate fixed on an upper surface of said magnet, wherein a magnetic gap is formed between said plate and said yoke; and a flat diaphragm provided with a coil and disposed above said magnetic gap;

wherein said magnet has a width greater than a width of said plate, and at least a part of said upper surface of said magnet is exposed and facing directly to said diaphragm; and wherein said yoke comprises a bottom yoke disposed at the bottom surface of said magnet and an outer yoke disposed at a side of said magnet.

2. The loudspeaker of claim 1, wherein said coil includes two portions, and a shortest distance between said two portions of said coil is smaller than a width of said magnet.

3. The loudspeaker of claim 1, wherein said magnet and said plate have a disc-shape, and said magnet has a diameter greater than a diameter of said plate.

4. The loudspeaker of claim 3, wherein said coil includes two portions, and a shortest distance between said two portions of said coil is smaller than the width of said magnet.

5. The loudspeaker of claim 3, wherein said yoke comprises a protruding yoke disposed at a center of said magnet, said protruding yoke is provided with a through hole, and a lead is taken out through said through hole.

6. The loudspeaker of claim 1, wherein said magnet and said plate have a ring-shape, and a protruding yoke is further provided at a center of said ring-shaped magnet and plate.

7. The loudspeaker of claim 6, wherein said coil includes two portions, and a shortest distance between said two portions of said coil is smaller than the width of said magnet.

8. The loudspeaker of claim 1, wherein said magnet constitutes a first magnet and said flat plate constitutes a first plate, wherein said magnetic circuit further comprises a second magnet provided with a second plate, and wherein said yoke includes a protruding yoke disposed between said first and second magnets so as to form a first magnetic gap between said first plate and said protruding yoke, and so as to form a second magnetic gap between said second plate and said protruding yoke.

9. The loudspeaker of claim 8, wherein said first magnet, said second magnet and said protruding yoke are disposed in parallel to each other.

10. The loudspeaker of claim 9, wherein said coil includes two portions, and said two portions correspond to said first and second magnetic gaps, respectively, and a shortest distance between said two portions of said coil is greater than a distance between said first and second magnets.

11. The loudspeaker of claim 8, wherein said first magnet, said second magnet and said protruding yoke are disposed concentric.

12. The loudspeaker of claim 11, wherein said coil includes two portions, and said two portions correspond to said first and second magnetic gaps, respectively, and a shortest distance between said two portions of said coil is greater than a distance between said first and second magnets.

13. The loudspeaker of claim 11, wherein said coil comprises first and second coil portions respectively disposed above said first and second magnetic gaps; wherein an inner diameter of an innermost one of said first and second coil portions is smaller than an outer diameter of an innermost one of said first and second magnets; and wherein an outer diameter of an outermost one of said first and second coil portions is greater than an inner diameter of an outermost one of said first and second magnets.

14. The loudspeaker of claim 11, wherein said coil includes two portions, and said two portions correspond to said first and second magnetic gaps, respectively, and winding directions of said two portions of said coil are reversed relative to each other.

15. The loudspeaker of claim 14, wherein said two portions of said coil form a continuous coil pattern.

16. The loudspeaker of claim 11, wherein said diaphragm is provided with wrinkles extending radially.

17. The speaker of claim 16, wherein said radial wrinkles are provided at substantially equal angular intervals.

18. The loudspeaker of claim 11, wherein said protruding yoke is provided with a through hole, and a lead is taken out through said through hole.

19. A loudspeaker comprising:

a round ring-shaped magnet;

a yoke fixed to a bottom surface of said magnet;

a round plate fixed on an upper surface of said magnet;

a protruding yoke disposed at a center of said magnet;

a magnetic circuit comprising a first magnetic gap formed between said plate and said yoke, and a second magnetic gap formed between said plate and said protruding yoke; and a flat diaphragm having a coil including two portions, said two portions of said coil corresponding to said first and second magnetic gaps, respectively, and having winding directions reversed relative to each other.

20. The loudspeaker of claim 19, wherein said magnet has a width that is greater than a width of said plate, and at least a part of an upper surface of said magnet is exposed and facing directly to said diaphragm.

21. The loudspeaker of claim 19, wherein said two portions of said coil form a continuous coil pattern.

22. The loudspeaker of claim 19, wherein said diaphragm is provided with wrinkles extending radially.

23. The loudspeaker of claim 19, wherein said radial wrinkles are provided at substantially equal angular intervals.

24. The loudspeaker of claim 19, wherein at least one of said protruding yoke, said magnet, and said yoke is provided with a through hole, and a lead is taken out through said through hole.

25. A loudspeaker comprising:

a magnetic circuit comprising a magnet, a yoke fixed to a bottom surface of said magnet, and a flat plate fixed on an upper surface of said magnet, wherein a magnetic gap is formed between said plate and said yoke; and a flat diaphragm provided with a coil and disposed above said magnetic gap;

wherein said magnet has a width greater than a width of said plate, and at least a part of said upper surface of said magnet is exposed and facing directly to said diaphragm;

wherein said coil includes two portions, and a shortest distance between said two portions of said coil is smaller than a width of said magnet; and wherein said magnet constitutes a first magnet and said flat plate constitutes a first plate, wherein said magnetic circuit further comprises a second magnet provided with a second plate, and wherein said yoke includes a protruding yoke disposed between said first and second magnets so as to form a first magnetic gap between said first plate and said protruding yoke, and so as to form a second magnetic gap between said second plate and said protruding yoke.

26. The loudspeaker of claim 25, wherein said first magnet, said second magnet and said protruding yoke are disposed concentric.

* * * * *